US006158466A

United States Patent [19]

Riefler

[11] Patent Number: 6,158,466

[45] Date of Patent: Dec. 12, 2000

[54] FOUR-WAY FLOW REVERSING VALVE FOR REVERSIBLE REFRIGERATION CYCLES

[75] Inventor: Roger G. Riefler, Jupiter, Fla.

[73] Assignee: Parker-Hannifin Corporation, Cleveland, Ohio

[21] Appl. No.: 09/477,898

[22] Filed: Jan. 5, 2000

Related U.S. Application Data

[60] Provisional application No. 60/115,831, Jan. 14, 1999.

[51] Int. Cl.[7] ..... F16K 11/10

[52] U.S. Cl. ..... 137/625.43; 62/324.6

[58] Field of Search ..... 137/625.43; 60/324.6

[56] References Cited

U.S. PATENT DOCUMENTS

| | | | |
|---|---|---|---|
| 2,780,077 | 2/1957 | Jacobs . | |
| 3,032,312 | 5/1962 | Greenawalt . | |
| 3,225,557 | 12/1965 | Miller . | |
| 3,335,756 | 8/1967 | McPherson . | |
| 3,738,573 | 6/1973 | Eschbaugh et al. . | |
| 3,867,960 | 2/1975 | Hosoda et al. . | |
| 3,894,561 | 7/1975 | Thornberry . | |
| 3,992,898 | 11/1976 | Duell et al. . | |
| 4,026,320 | 5/1977 | Grahl . | |
| 4,087,986 | 5/1978 | Grahl . | |
| 4,318,425 | 3/1982 | Marks . | |
| 4,324,273 | 4/1982 | Bauer et al. . | |
| 4,406,306 | 9/1983 | Kolze . | |
| 4,432,215 | 2/1984 | Yoshida . | |
| 4,448,211 | 5/1984 | Yoshida . | |
| 4,466,457 | 8/1984 | Brane et al. | 137/599.1 |
| 4,546,955 | 10/1985 | Beyer et al. . | |
| 4,573,497 | 3/1986 | White . | |
| 4,582,294 | 4/1986 | Fargo . | |
| 4,624,282 | 11/1986 | Fargo . | |
| 4,644,760 | 2/1987 | Aoki et al. . | |
| 4,649,360 | 3/1987 | Riefler et al. . | |
| 4,891,960 | 1/1990 | Ellison . | |
| 5,026,022 | 6/1991 | Bastle . | |
| 5,048,791 | 9/1991 | Ellison et al. . | |
| 5,074,329 | 12/1991 | Havemann et al. . | |
| 5,127,624 | 7/1992 | Domke . | |
| 5,186,021 | 2/1993 | Keller . | |
| 5,252,939 | 10/1993 | Riefler et al. . | |
| 5,295,656 | 3/1994 | Campbell et al. . | |
| 5,299,431 | 4/1994 | Iritani et al. . | |
| 5,303,012 | 4/1994 | Horlacher et al. . | |
| 5,309,731 | 5/1994 | Nonoyama et al. . | |
| 5,316,074 | 5/1994 | Isaji et al. . | |
| 5,341,656 | 8/1994 | Rust, Jr. et al. . | |
| 5,386,704 | 2/1995 | Benedict . | |
| 5,390,897 | 2/1995 | Campbell et al. . | |
| 5,419,368 | 5/1995 | Flondella et al. . | |
| 5,460,349 | 10/1995 | Campbell et al. . | |
| 5,553,829 | 9/1996 | Hemsen . | |

FOREIGN PATENT DOCUMENTS

WO 96/00664 1/1996 WIPO .

OTHER PUBLICATIONS

U.S. Patent application Serial No. 60/041/525 (now abandoned) entitled "Directional Flow Control Valve for Refrigeration System Having Fluid Metering Capability".

*Primary Examiner*—John Fox
*Attorney, Agent, or Firm*—John A. Molnar, Jr.

[57] ABSTRACT

A directional flow control or reversing valve for use within a thermodynamic system wherein a working fluid is cycled through a closed-loop fluid circuit having refrigeration elements including a first heat exchanger or coil, a second heat exchanger or coil coupled in series to the first heat exchanger, and a compressor having a high pressure discharge side and a low pressure suction side. The control valve includes distribution and check valving elements that are operable for selectively directing the flow of fluid from the compressor discharge side to the first or second heat exchanger and, respectively, the compressor suction side to the second or first heat exchanger for the reversible operation of the system in alternate heating and cooling modes. The valve includes a housing which is formed as having internal chambers for receiving the valving elements, and fluid ports which open into the housing as couplable in fluid communication with the refrigeration elements of the fluid circuit.

18 Claims, 4 Drawing Sheets

FOUR-WAY FLOW REVERSING VALVE FOR REVERSIBLE REFRIGERATION CYCLES

RELATED CASES

The present application claims priority to U.S. Provisional Application Ser. No. 60/115,831; filed Jan. 14, 1999.

BACKGROUND OF THE INVENTION

The present invention relates broadly to directional flow control valves for diverting the flow of a working fluid between two or more fluid flow paths, and particularly to a four-way valve of such variety adapted for use in heat pump systems and other reversible refrigeration cycles for reversing the direction of refrigerant flow in the circuit loop to alternately heat or cool the environment being controlled by the cycle.

Air conditioning and other refrigeration systems are operated in a thermodynamic cycle which conventionally may employ in series, as is shown at 10 in FIG. 1, a compressor, 12, a first heat exchanger 14, which may be an outdoor condenser, an expansion function, represented at 16, and a second heat exchanger, 18, which may be an indoor evaporator, all of which are arranged in a closed-loop circuit. Within such circuit 10, a refrigerant medium is cycled therethrough for its alternate conversion from a partially liquid state to a partially gaseous state effecting a conversion of heat to kinetic energy.

When operated in a conventional cooling mode, energy is supplied into the thermodynamic cycle via the compressor 12 which is operated as having a low pressure inlet or suction side, 20, and a high pressure outlet or discharge side, 22. Within the compressor, the refrigerant is compressed and super-heated to exit the outlet side 22 thereof via line 24 at a relatively high pressure. The refrigerant next is passed via line 25 through the first heat exchanger 14 wherein a heat transfer is effected with a lower temperature fluid to remove the heat of compression from the refrigerant for its further cooling. From the first heat exchanger 14, the flow of the refrigerant, which is now in a liquefied and pressurized state, is regulated by the expansion function 16 and then is passed into the second heat exchanger 18. The refrigerant within the second heat exchanger 18 is volumetrically expanded with a state change from a high to a low pressure liquid, and subsequently a phase change to a low pressure gas. The specific and latent heats associated with the state and phase changes of the refrigerant effect the cooling of the area surrounding the second heat exchanger 18 or, with forced convective systems, of a higher temperature cooling medium such as air which is circulated in a heat transfer relationship with the heat exchanger. From the second heat exchanger 18, the refrigerant, now in a relatively low pressure gaseous phase, is returned via lines 26 and 27 to the suction side 20 of the compressor 12 wherein it is again compressed and thereafter cooled for the repetition of the cycle.

However, and as is detailed in U.S. Pat. Nos. 3,867,960; 3,894,561; 3,992,898; 4,406,306; 5,186,021; and 5,341,656, refrigeration systems of the above-described type also may be operated in an alternate thermodynamic or "heat pump" cycle to additionally heat the working environment. When operated in such mode, the duty of the two heat exchangers typically is reversed thermodynamically by physically reversing the direction of the flow of refrigerant through the system, i.e., from the compressor discharge side 22 to the second heat exchanger 18 via lines 24 and 26, and then to the first heat exchanger 14 and returning to the compressor suction side 20 via lines 25 and 27. In this regard, and as is shown at 30 in FIG. 1, a multi-position, flow reversing control valve may be coupled in fluid communication with the suction and discharge sides of the compressor to selectively connect the heat exchangers to alternate sides of the compressor such that the first heat exchanger may be operated in a cooling or evaporator mode, with the second heat exchanger being operated in a heating or condenser mode.

To complete the thermodynamic reversal of the cycle, the refrigerant within circuit 10 must be throttled in the opposite direction through the expansion device. Therefore, the expansion function of such circuits conventionally may employ a double expansion device arrangement wherein a pair of expansion devices, referenced in FIG. 1 at 16*a–b*, are positioned in opposition within a supply line, 32, extending between heat exchangers 14 and 18. That is, devices 16*a–b* are arranged to throttle refrigerant in opposite directions. Expansion devices, which encompass capillary tubes, thermostatic expansions valves, and orifice piston-operated check valves, are further described in U.S. Pat. Nos. 5,695,225; 5,564,754; 5,553,902; 5,460,349; 5,390,897; 5,341,656; 5,295,656; 5,131,695; 4,674,673; 4,643,222; 3,992,898; 3,877,248; 3,745,787; 3,120,743; and D341,409. Further, it is common practice to distribute the refrigerant discharged from each of the expansion devices 16 into a plurality of different circuit tubes, one of which is referenced at 34*a* for device 16*a*, and at 34*b* for device 16*b*, each of which is connected to a different section of the corresponding heat exchanger coil.

A representative flow reversing or control valve of the general type herein involved is disclosed in U.S. Pat. No. 4,318,425 as including a valve housing defining a chamber in which a bearing surface is disposed with refrigerant port openings in the bearing surface. A valving member is slidably disposed on the bearing surface for selective communication with desired ports.

Another flow valve is disclosed in U.S. Pat. No. 4,644,760 as including a cylindrical valve body through which a single piston is adapted to slidably reciprocate in a differential pressure arrangement. The piston divides the valve body into two chambers, one of which is used for admitting high pressure gas thereinto, and the other of which is used for controlling the piston in counteracting the high pressure gas. A spring is used to urge the piston toward the high pressure chamber.

U.S. Pat. No. 4,573,497 discloses another refrigerant flow valve which includes a tubular valve body defining fluid ports. A valving member is supported by the body for movement with respect to the ports to direct refrigerant flow into different flow paths. Refrigerant flow tubes are hermetically fixed to the valve body for directing the refrigerant flow from the refrigeration system through the valve body. A heat transfer blocking structure is used to provide a high thermal impedance conductive heat transfer path through and along the valve flow tubes for minimizing heat transfer between the refrigerant and the flow tube walls.

U.S. Pat. No. 3,032,312 discloses a valve having a chamber with a plurality of adjacent fluid ports and a recessed slide member which is selectively slidable over certain ports to open and close alternate fluid passages. The slide member comprises a shell-like structure having a flexible, low-friction seal surrounding an open edge and presenting a fluid-tight surface for engaging the port area of the valve chamber. The shell is formed of two separate elements having rim sections which are shaped to mechanically secure the seal to the shell. Concave surfaces of the elements are spaced-apart intermediate the rim edges to provide a heat exchange barrier.

U.S. Pat. No. 5,074,329 discloses a three-way valve for a refrigeration system in which flow is alternately directed from a compressor to a condenser or an evaporator. The valve includes a valve body portion which defines fluid ports and an internal, elongate cavity. A cylindrical cartridge is disposed within the cavity and is movable therein to provide first and second operative positions. A pressure limiting or equalizing check valve is coaxially carried by the cartridge for limiting back pressure build-up.

U.S. Pat. No. 4,324,273 discloses a valve construction having a housing that is provided with a movable valve unit member. The valve member is interconnected to a piston unit having opposed piston heads that define a main chamber of the housing. The housing has opposing ends, each of which defines a control chamber which a respective one of the piston heads and has a valve seat leading to one of the control chambers. Each piston head has a flexible seal member which is adapted to close a valve seat defined by a respective end of the housing.

U.S. Pat. Nos. 4,448,211 and 4,432,215 disclose three-way valve constructions of a pressure-differential variety for use in refrigeration systems. The valve constructions include a control mechanism which is disposed within a main valve body. The control mechanism is provided for bringing a first valve in contact with a first valve seat of the valve body when the pressure within a first valve chamber is higher than a pressure within an opposing second valve chamber, and for bringing a second valve in contact with a second valve seat of the valve body when the pressure within the second valve chamber is higher than the pressure within the first valve chamber.

U.S. Pat. No. 4,319,607 discloses a valve assembly which includes a housing having an elongated central passageway and a plurality of spaced ports and valve openings along the length thereof, with the valve openings providing communication between adjacent ones of the spaced ports. An elongated drive shaft, which is movable by a hydraulic pressure actuator between a resting position and an actuated position, is disposed on the drive shaft and is biased at its resting position by a spring disposed around the shaft. A plurality of free floating sealing elements are spaced along the shaft as separated by another spring disposed in the housing around the shaft. Each of the valve elements is disposed between a pair of adjacent valve openings and is movable to open or close the one of the valve openings by the movement of the shaft. In one embodiment, as the shaft is moved to open one of the valve elements, the other is maintained in a closed orientation until contacted by an enlarged portion of the shaft.

U.S. Pat. No. 3,335,756 discloses an automatic sequencing valve for directing a fluid flow sequentially to first and second outlets spaced longitudinally and differentially from a common inlet. The valve includes a valve body which defines the inlet and outlet ports and associated valve seats, as well as an internal chamber in communication with the ports. A pressure-responsive piston valve is received within the chamber and is movable therein into and out of engagement with the valve seats thereby opening and closing the fluid ports. A stem additionally is received within the body as operably connected to the piston for movement therewith to open and close one of the valve outlets. A capillary tube may be provided in communication with opposite ends of the chamber for imposing a time delay on the motion of the stem relative to the motion of the piston.

U.S. Pat. No. 3,225,557 discloses a three-way valve which includes a body portion having a cylindrical chamber, and compressor discharge, compressor suction, and evaporator ports opening into such chamber. The valve also includes a piston which is movable within the chamber for controlling fluid communication between the ports, and a solenoid for controlling the movement of the piston.

U.S. Pat. No. 3,894,561 discloses a four-way reversing valve for refrigeration systems. Within the valve, a three-way pilot valve is employed to control application of high or low system pressure to the end of chamber which is adjacent the larger end of a double-headed, differential area piston.

U.S. Pat. No. 3,867,960 discloses a five-way reversing valve wherein the flow direction of two pressurized fluid streams can be simultaneously changed by way of a pressure differential between the two fluids. The flow directions are changed by the combined operations of an elastic coil spring and a slidable plunger whose movement is controlled by the spring.

U.S. Pat. No. 4,406,306 discloses a switch-over valve for use within a heat pump system. The valve includes a body having discharge and suction ports for interconnection with the heat pump compressor, and two reversing valve ports for interconnection with the heat pump coils. The valve further includes a solenoid-operated pilot valve, a slave valve for selectively interconnecting the discharge port with one of the reversing valve ports, and a shuttle poppet valve for interconnecting the suction port with the other reversing valve port.

Other flow control valves and refrigeration systems are described in U.S. Pat. Nos. 2,780,077; 3,738,573; 4,026,320; 4,087,986; 4,112,974; 4,144,905; 4,212,324; 4,213,483; 4,237,933; 4,241,486; 4,248,058; 4,255,939; 4,292,720; 4,311,020; 4,492,252; 4,573,497; 4,712,582; 4,791,960; 4,825,908; 5,026,022; 5,048,791; 5,299,431; 5,309,731; 5,316,074; 5,386,704; and 5,507,315, and in and in Int. Publ. No. WO 96/00664.

The above-described references have constituted the state of the art with respect flow control switching, sequencing, reversing, or diversion valves for heat pumps and other refrigeration systems. It is believed, however, that further improvements in flow reversing valves for such systems continue to be desired by manufacturers. In this regard, a preferred valve construction would be economical to manufacture, but additionally would be reliable, efficient, and compact so as to be easily incorporated in existing air conditioning system designs.

SUMMARY OF THE INVENTION

The present invention is directed to a directional flow control valve for a thermodynamic system, and particularly to a reversing valve construction especially adapted for application within a heat pump or other reversible refrigeration system. In accordance with the precepts of the present invention, such reversing valve construction integrates distribution and switch or check valving functions within a compact, unitary housing.

For incorporation within a heat pump circuit, the valve housing is formed as including discharge and suction ports couplable in fluid communication with the corresponding sides of the heat pump compressor, and two reversing ports each couplable in fluid communication with a corresponding one of the heat pump coils. The housing further is formed as having a pair of internal chambers for receiving distribution and check valving elements. In an illustrated embodiment, the distribution valving function is provided via a solenoid piloted, 3-way diversion valve element of a double-headed, differential piston variety, with the check valving function being provided by a 2-way shuttle which may be a pair of discs mounted at either end of a common shaft. The distribution valving element is operably coupled in fluid communication with the compressor discharge port, with the check valving element being operably coupled in fluid communication with the distribution valving element and the compressor suction port, and also with, selectively, the reversing ports to alternately couple each of the reversing ports with the compressor discharge or suction port.

Compressor discharge pressure is continuously provided to a smaller one of the diversion valve element pistons to normally bias the element in a first orientation, and is selectively applied as pilot pressure to a larger one of the pistons. In this way, the element is selectively and reciprocatingly movable intermediate a pair of associated valve seats from the normally-biased first orientation to a second orientation alternately applying discharge pressure to either end of the check valve element. Responsive to this discharge pressure, the check valve element, in turn, is freely slidable movable within its corresponding chamber to alternately engage one of a spaced-apart pair of corresponding valve seats. With one end of the shuttle engaged with its corresponding valve seat to close the fluid flow path between one of the reversing ports and the discharge port, the other end is disengaged from its corresponding valve seat to open a fluid path between the suction port and the other reversing port. In this regard, each of the shuttle discs is provided as having at least one and, preferably, a series of apertures disposed radially outwardly of its corresponding valve seat to apertures provide such fluid flow path between the suction port and the reversing ports.

In operation, compressor discharge pressure is applied to the larger piston of the diversion valve element to dispose such element in its second orientation opening fluid communication between a first one of the reversing ports and the discharge port. Simultaneously, discharge pressure also is applied to one end of the check valve element to dispose the element in an orientation closing the fluid flow path between the first reversing port and the suction port, and opening the flow path between the other, second reversing port and the suction port. Alternately, with discharge pressure discontinued to the larger piston of the diversion valve element, such element returns to its normally biased first orientation opening fluid communication between the second one of the reversing ports and the discharge port, and simultaneously applying pressure to the other end of the check valve element to dispose the element in an orientation closing the fluid flow path between the second reversing port and the suction port, and opening the flow path between the first reversing port and the suction port. In this way, the compressor discharge pressure is reversibly directed to one of the two system heat exchanger coils, with the compressor suction being reversibly connected to the other coil.

With the orientation of the switching or check valving element being determined by fluid pressure controlled by the diversion valving element, the above-described construction advantageously effects a reversing function without the need of spring forces. Indeed, the only resistance forces necessary are the U-cup or other seal forces of the diversion valving element. That is, the check valving element does not require any springs or any sliding U-cup, O-ring, or other fluid seals, and therefore may be made freely slidably moveable, i.e., without the resistance of such springs or seals, within its corresponding chamber. The reversing function thereby may be effected with compressor discharge pressures as low as 15 psi, which makes the subject valve construction extremely energy efficient. Further, as once the reversing function is effected compressor discharge pressure is utilized to seat the shuttle disc of the check valving element, such construction also is seen as providing very positive, leak-free performance for further optimization of system efficiency.

A feature of the preferred embodiments of the present invention therefore is to provide a fluid control valve for directing flow through a refrigeration or other fluid system. A further feature is to provide a reversing valve within a heat pump or other refrigeration system for selectively and reversibly directing the flow of refrigerant from the high pressure side of a compressor to one of the two system heat exchanger coils.

Advantages of the present invention include a reversing or other directional flow control valve construction valve construction which is compact and economical to manufacture and assemble, and which is extremely energy efficient. Additional advantages include a valve construction which provides very positive, leak-free performance. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
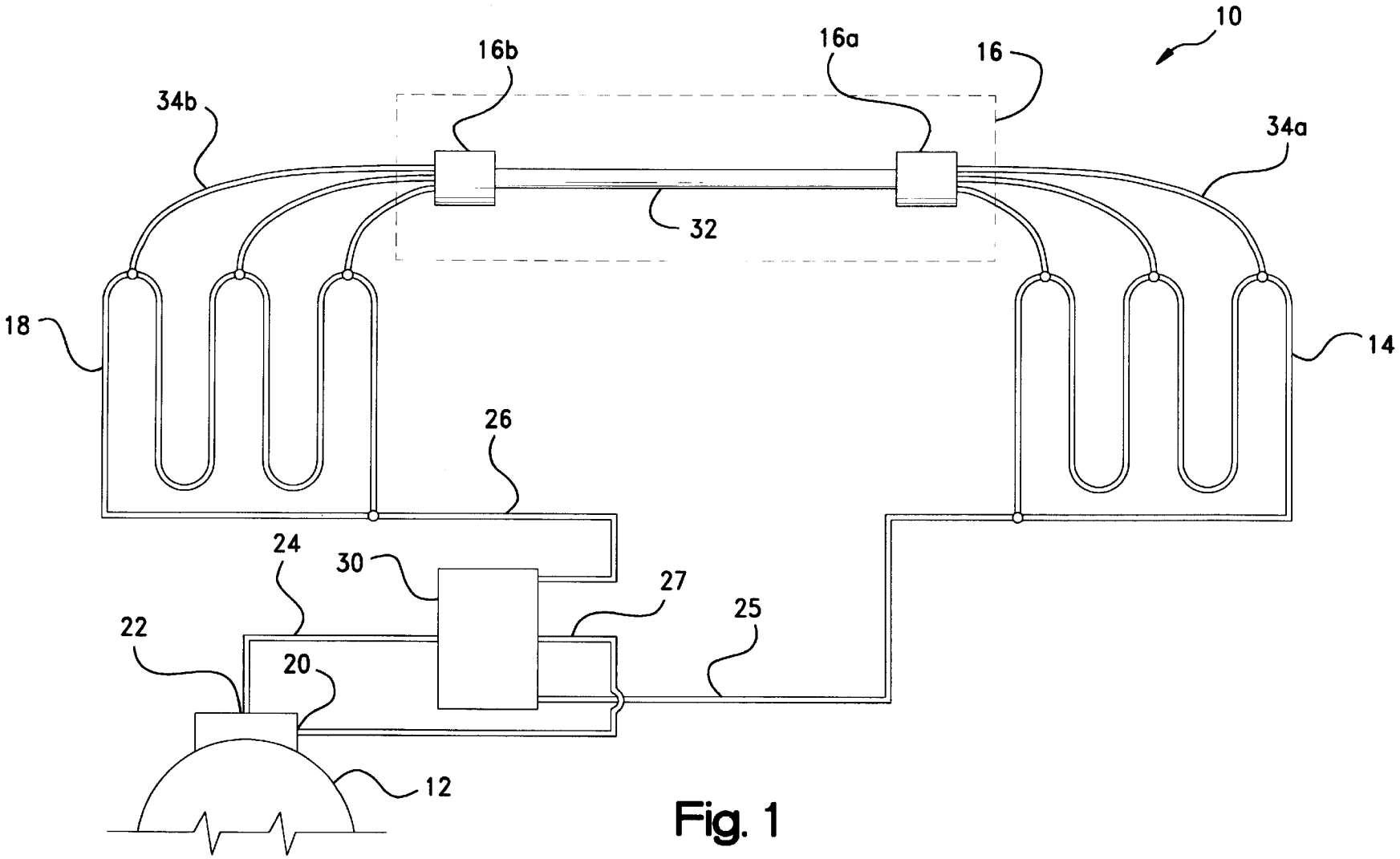
FIG. 1 is schematic fluid flow diagram showing a representative refrigeration circuit which may be operated in a reversible thermodynamic cycle to provide alternate heating and cooling modes.

The drawings will be described further in connection with the following Detailed Description of the Invention.

DETAILED DESCRIPTION OF THE INVENTION

Certain terminology may be employed in the following description for convenience rather than for any limiting purpose. For example, the terms "forward," "rearward," "right," "left," "upper," and "lower" designate directions in the drawings to which reference is made, with the terms "inward," "inner," or "inboard" and "outward," "outer," or "outboard" referring, respectively, to directions toward and away from the center of the referenced element, the terms "radial" and "axial" referring, respectively, to directions or planes perpendicular and parallel to the longitudinal central axis of the referenced element, and the terms "downstream" and "upstream" referring, respectively, to directions in and opposite that of fluid flow. Terminology of similar import other than the words specifically mentioned above likewise is to be considered as being used for purposes of convenience rather than in any limiting sense.

For the purposes of the discourse to follow, the precepts of the flow reversing or other directional flow control valve construction of the of the invention herein involved are described in connection with its utilization within a refrigeration system, such as the "heat pump" circuit shown in FIG. 1, wherein a compressible refrigerant medium is reversibly cycled as the working fluid along a closed loop path. It will be appreciated, however, that aspects of the present invention may find application in within other refrigeration or fluid circuits. Use within those such other applications therefore should be considered to be expressly within the scope of the present invention.

Figure 2:
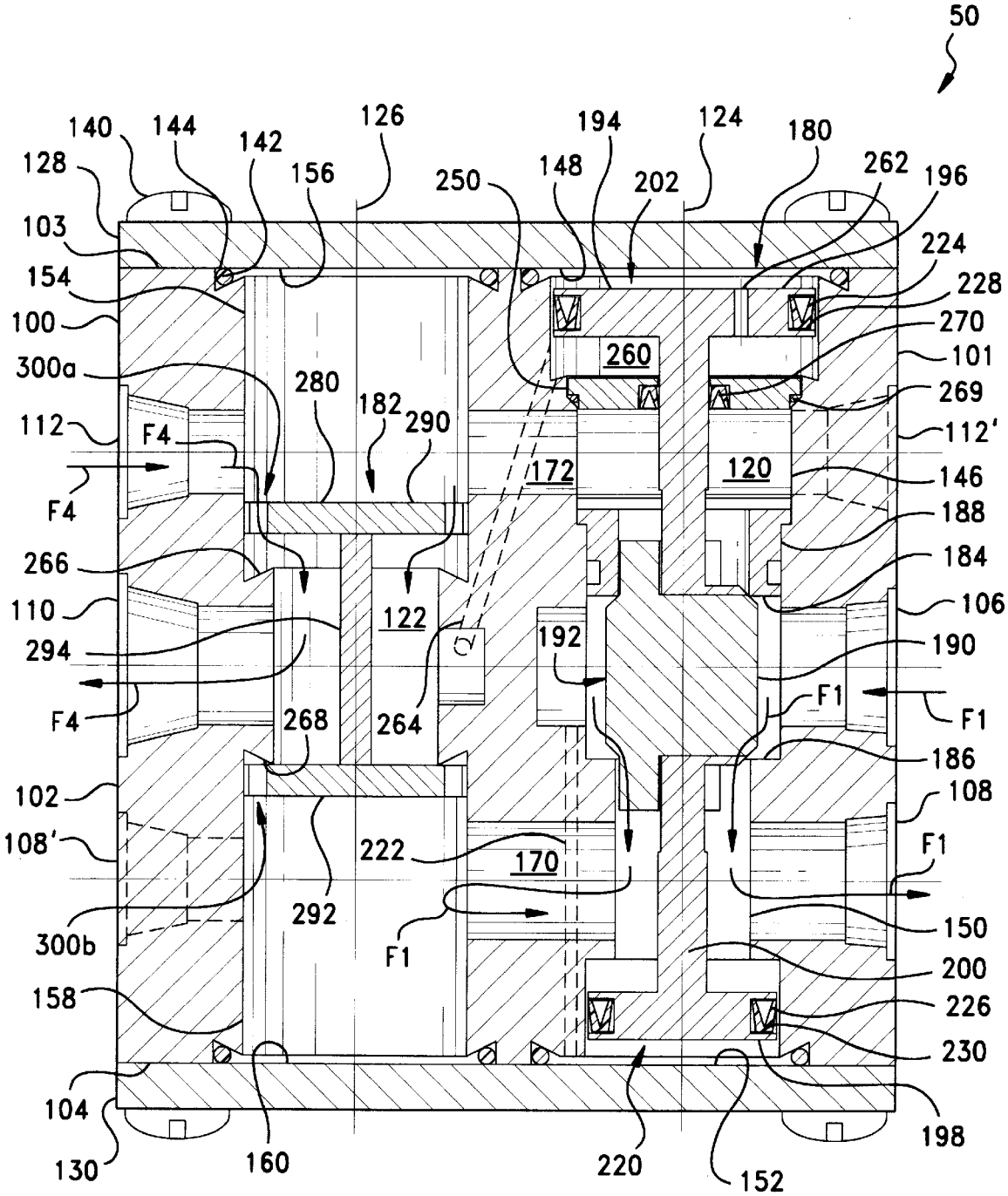
FIG. 2 is a cross-sectional view of an representative embodiment of a directional flow control or reversing valve construction according to the present invention as adapted particularly for incorporated within a heat pump or other reversible refrigeration circuit having a compressor and a pair of heat exchanger coils, the reversing valve being shown in a de-energized state for operation of the circuit in a cooling or heating mode.
Figure 3:
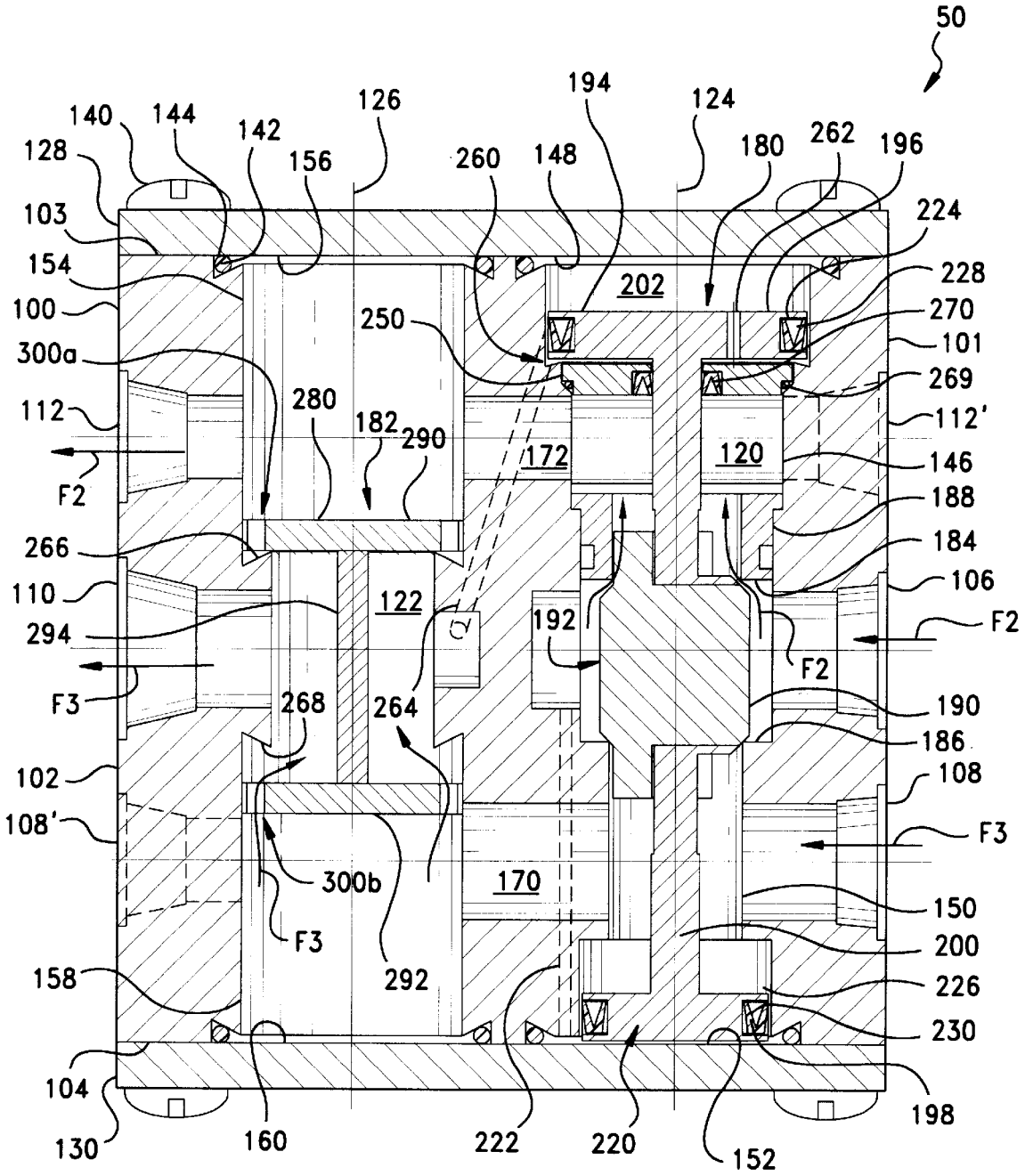
FIG. 3 is a cross-sectional view showing the reversing valve of FIG. 2 in an energized state for operation of the refrigeration circuit in an alternate, reversed mode.

Referring then to the remaining figures wherein corresponding reference numbers are used to designate corresponding elements throughout the several views, in accordance with the precepts of the present invention, each of the valving and other fluid circuit functions encompassed within the box referenced at 30 in FIG. 1 advantageously may be integrated within a unitary block valve assembly having a volume, for example, of 1 liter or less for ease of installation into confined areas such as within a heat pump unit. Considering jointly FIGS. 2 and 3, a representative valve assembly of the present invention is shown generally at 50 as configured for incorporation within the reversible "heat pump" circuit 10 of FIG. 1. In this regard, the valve assembly 50 is controllable, as represented in FIG. 2, in a de-energized mode to operate circuit 10 of FIG. 1 such that the first heat exchanger 14 is coupled, for example, in fluid communication with the discharge side of the compressor 12, with the second heat exchanger 18 being coupled in fluid communication with the suction side of the compressor. Additionally, the valve assembly 50 is controllable, as is represented in FIG. 3, in an energized, alternate second mode to operate circuit 10 such that the second heat exchanger 18 is coupled in fluid communication with the discharge side of the compressor 12, with the first heat exchanger 14 being coupled in fluid communication with the suction side of the compressor. For heat pump applications, one of the heat exchanger coils 14 or 18 may be disposed inside of or otherwise in fluid communication with the controlled environment with the other coil being disposed outside of the controlled environment to effect the operation of circuit 10 in alternate heating and cooling modes. Depending upon the application, the fluid connections of the valve assembly 50 within the circuit 10 also may be switched to reverse the above-described energized and de-energized operations.

Considering the structure of valve assembly 50, continuing reference may be had to FIGS. 2 and 3 wherein a cross-sectional view of the valve is shown in a de-energized orientation in FIG. 2 and in an energized orientation in FIG. 3. In basic construction, valve assembly 50 includes a housing body, 100, which may be of a generally polygonal geometry presenting pairs of opposing end and side surfaces defining a compressor discharge face, 101, a compressor suction face, 102, and upper and lower end faces 103 and 104. For the fluid connection of valve 50 within refrigeration circuit 10 of FIG. 1, each of the faces 101 and 102 is formed as having one or more fluid port openings. In this regard, compressor discharge face 101 includes an inlet or discharge port, 106, for connection to the pressure, i.e., discharge, side of the compressor 12 of FIG. 1, and a first reversing or heat exchanger port, 108, for connection to a corresponding one of the first or second heat exchangers 16 or 18. Compressor suction face 102, in turn, includes an outlet or suction port, 110, for connection the suction side of the compressor 12, and a second reversing or heat exchanger port, 112, for connection to the other one of the first or second heat exchanger 16 or 18. The described ports 106, 108, 110, and 112 are operated under the control of one or more internal valving elements each of which are actuable to route the flow of refrigerant fluid through the valve assembly 50 to effect the operation of circuit 10 (FIG. 1) in the described alternate heating and cooling modes.

For receiving these valving elements, housing body 100 further is formed, as may be seen with continuing reference to FIG. 2, as having internal first and second chambers, shown at 120 and 122, each of which is generally cylindrical in extending along a corresponding longitudinal axis, respectively, 124 and 126. For ease of the boring or other machining of chambers 120 and 122 into body 100, axes 124 and 126 may be disposed generally parallel and the valve assembly housing additionally may be constructed as including separate upper and lower end plates, 128 and 130, each of which is mounted over a corresponding end face 103 or 104. In this regard, the assembly thereby may be secured as shown with a plurality of fastening members, one of which is referenced as screw 140. An O-ring or other seal member, one of which is referenced at 142, may be received within a associated groove, 144, formed about each end of chambers 120 and 122. Such seal members 142 thereby are compressible between the housing body 100 end faces 103 or 104 and the corresponding upper or lower end plate 128 or 130 to effect a fluid-tight sealing of the chambers 120 and 122 within the housing body.

First chamber 120 is provided to extend along axis 124 from a first upper end portion, 146, terminating at a first upper end wall, 148, defined by upper end plate 128, to a first lower end portion, 150, terminating at a first lower end wall, 152, defined by lower end plate 130. Second chamber 122, in turn, extends along axis 126 from a second upper end portion, 154, terminating at a second upper end wall, 156, similarly defined by upper end plate 128, to a second lower end portion, 158, terminating at a second lower end wall, 160, similarly defined by lower end plate 130. For admitting and exhausting fluid from chambers 120 and 122, inlet port 106 is provided to open into chamber 120 intermediate the first upper and lower end portions 146 and 150 thereof, with outlet port 110 being provided to open into chamber 122 intermediate the second upper and lower end portions 154 and 158 thereof.

A first internal conduit, 170, extends generally laterally within housing 100 to define a portion of a first fluid flow path, referenced by the arrows designated F1 in FIG. 1, in connecting the first lower end portion 150 of first chamber 120 in fluid communication with the second lower end portion 158 of chamber 122. With first reversing port 108 being provided to open into the first fluid flow path F1 via the first lower end portion 150 of chamber 120, port 108 thereby is couplable by path F1 in fluid communication with inlet port 106. As is shown in phantom at 108' and depending upon the porting requirements of the intended application, first reversing port 108 alternatively may be provided to open into fluid flow path F1 via the second lower end portion 158 of the second chamber 122.

For defining a portion of a second fluid flow path, referenced by the arrows designated F2 in FIG. 3, a second internal conduit, 172, further is provided to extend generally laterally within housing 100 in connecting the first upper end portion 146 of first chamber 120 in fluid communication with the second upper end portion 154 of chamber 122. With second reversing port 112 being provided to open into the second fluid flow path F2 via the second upper end portion 154 of chamber 122, port 112 thereby is couplable by path F2 in fluid communication with inlet port 106. As is shown in phantom at 112', and again as depending upon the porting requirements of the intended application, second reversing port 112 alternatively may be provided to open into fluid flow path F2 via the first upper end portion 146 of the first chamber 120.

Into each of chambers 120 and 122 is received, respectively, a three-way distribution valving element, shown generally at 180, and a two-way check valving element, shown generally at 182. Distribution valving element 180 effects a distribution valving function within the valve assembly 50 in selectively opening and closing the first and second fluid flow paths F1 and F2. Check valving element 182, in turn, effects a switch valving function within valve assembly 50 in alternatingly opening and closing a third fluid flow path, referenced by the arrows designated F3 in FIG. 3, coupling the first reversing port 108 in fluid communication with the outlet port 110, and a fourth fluid flow path, referenced by the arrows designated F4 in FIG. 2, coupling the second reversing port 112 in fluid communication with the outlet port 110. That is, distribution valving element 180 is reciprocatingly movable within chamber 120 along axis 124 to selectively open and close flow paths F1 and F2 for directing the flow of refrigerant fluid from, for example, the high pressure discharge side 22 of compressor 12 (FIG. 1) to one of the first or second heat exchangers 14 or 18. As controlled by the orientation of the distribution valving element 180, the check valving element 182, in turn, is reciprocatingly movable within chamber 122 along axis 126 to alternately open and close the third and fourth fluid flow paths F3 and F4 for directing the flow of refrigerant from the other of the first or second heat exchangers 14 or 18 to the low pressure suction side 20 of the compressor 12.

Considering then the operation of the distribution valving element 180, such element preferably is provided as being of a double-piloting, differential piston variety. Accordingly, first upper and lower valve seats, 184 and 186, may be seen to be defined within chamber 120 intermediate first upper and lower end walls 148 and 152 and as spaced apart axially along longitudinal axis 124 with upper valve seat 184 being disposed between port 106 and conduit 172, and with lower valve seat 186 being disposed between port 106 and conduit 170. As is shown, first lower valve seat 186 may be integrally formed within chamber 120 by a stepwise reduction in the diameter thereof to define an internal shoulder, with first upper valve seat 184 preferably being defined by the inner radial surface of a separate annular packing or other insert component, 188, which is received within chamber 120. It will be appreciated that the provision of first upper valve seat 184 as a separate component facilities the assembly of valving element 180.

For controlling the direction of fluid flow through valving element 180, a distribution or diversion valve disc, 190, is slidably received within an enlarged-diameter gland portion, referenced at 192, defined within chamber 180 intermediate first upper and lower valve seats 184 and 186. Disc 190 thereby is received within gland 192 for reciprocating movement along longitudinal axis 124 intermediate a first position, shown in FIG. 2, disposed in abutting engagement with first upper valve seat 184 opening first fluid flow path F1 and closing second fluid flow path F2, and a second position, shown in FIG. 3, disposed in abutting engagement with first lower valve seat 186 opening second flow path F2 and closing first fluid flow path F1.

For moving disc 190 between its first and second positions, a double piston assembly, 194, additionally is received within chamber 120 as operably coupled with the disc. As may be seen, piston assembly 194, which may be of a unitary or multi-part construction, includes an upper piston head portion, 196, and a lower piston head portion, 198. An elongate stem portion, 200, extends intermediate the head portions 198 and 200, into coaxial connection with disc 190. As thereby coupled with disc 190, piston assembly 194 is slidably movable within chamber 120 responsive to fluid pressure directed on the upper and lower pistons head portions 196 and 198 thereof between a first orientation (FIG. 2) disposing disc 190 in its first position opening flow path F1 and closing path F2, and a second orientation (FIG. 3) disposing disc 190 is its second position opening flow path F2 and closing path F1.

Figure 4:
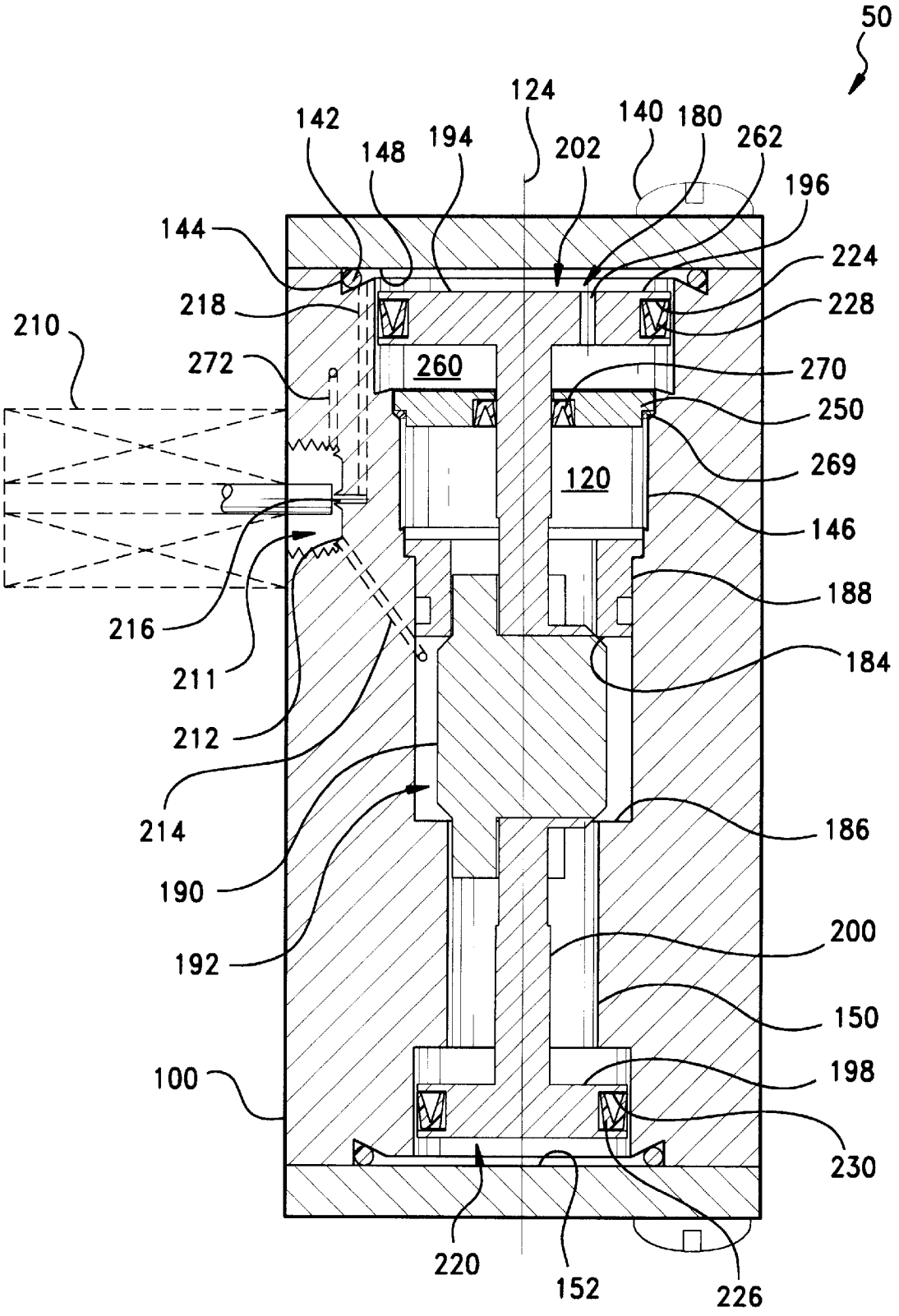
FIG. 4 is a cross-section view of the reversing valve of FIG. 2 taken trough a plane parallel to one of the port faces thereof and showing a representative arrangement for a solenoid pilot cavity and internal porting therefor.

To be further responsive to the fluid pressure directed thereon, upper piston head portion 196, which is of a first given diameter, is made to define with the housing first upper end wall 148 a first upper plenum, referenced at 202, within chamber 120 for receiving working fluid pressure controlling the downward movement of the piston assembly 194. Such pressure preferably is provided under the control of a pilot valving element, shown in phantom at 210 in the cross-sectional view of FIG. 4, which may be externally mounted to one of faces of body 100 via a countersunk cavity, 211, formed therein. Cavity 211 is provided with associated porting for valving element 210 including an inlet, 212, coupled in fluid communication with compressor discharge port 106 via internal passageway 214 formed within housing body 100, and an outlet, 216, coupled in fluid communication with first upper plenum 202 via internal passageway 218. Pilot valving element 210 preferably is provided to be of a conventional two-way, solenoid-variety, such as a type Gold Ring™ Series 20 manufactured by Parker-Hannifin Corp., Madison, Miss., which is energizable by a control input signal to admit fluid pressure into upper plenum 202 effecting the downward movement of piston assembly 194 disposing disc 190 in its second position (FIG. 3) opening second fluid flow F2. Alternately, pilot valving element 210 may de-energized effecting the venting of fluid pressure from upper plenum 202 for the upward movement of the piston assembly 194 disposing disc 190 in its first orientation (FIG. 2) opening flow path F1.

Returning to FIGS. 2 and 3, lower piston head portion 198, in turn, may be seen to be sized of a second diameter which similarly defines with housing second lower end wall 152 a first lower plenum, represented at 220, for receiving fluid pressure from compressor discharge port 106 via internal passageway 222. Packings or other seals rings, two of which are referenced at 224 and 226, may be conventionally provided about piston heads 196 and 198 as each received within and associated circumferential groove 228 or 230 to effect a dynamic, fluid-tight sealing of the corresponding piston head.

With the diameter of upper piston head portion 196 being provided, as shown in FIGS. 2 and 3, to be larger than that of lower piston head 198, a differential force imbalance is thereby developed which advantageously biases piston assembly 194 in its first orientation (FIG. 2) when the fluid pressures in the first upper and lower plenums 202 and 220 are about equal. Accordingly, with working fluid pressure being supplied to the upper and lower plenums, piston assembly 194 is thereby is actuated to its second orientation (FIG. 3) opening fluid flow path F2 and closing path F1. For returning the piston assembly to its normally-biased first orientation (FIG. 2) opening the fluid flow path F1 and closing path F2, the pressure in upper plenum 202 may be vented to suction or otherwise released, with fluid pressure continuing to be supplied to lower plenum 220 from discharge port 106. Alternatively, a compressible spring or the like may be substituted within chamber 220 for the described arrangement of the lower piston head and plenum for normally biasing the piston assembly in its first orientation. However, the preferred double-piston operation advantageously allows for the control of the distribution valving element 180 under conditions of relatively low operating pressures.

With continued reference to FIGS. 2 and 3, for the controlled venting of fluid pressure from upper plenum 202, a sealed plate or other generally planar member, 250, may be mounted transversely within chamber 120 intermediate upper piston head 196 and inlet port 106 for defining a suction plenum, referenced at 260. Suction plenum 260 is connected in fluid communication with first upper plenum 202 via an orifice, represented at 262, formed longitudinally through upper piston head 196. Fluid venting communication is provided from suction plenum 260 to suction outlet port 110 via passageway 264 which extends from the suction plenum to a connection with second chamber 122 intermediate a pair of second upper and lower valve seats, 266 and 268. In such arrangement, with pilot valving element 210 being energized as in FIG. 3 for supplying a given fluid pressure into first upper plenum 202 disposing piston assembly 194 in its second orientation opening fluid flow path F2, and with such fluid pressure also being supplied to lower plenum 220, the pilot valve may be de-energized to interrupt the supply of fluid pressure into the first upper plenum. The given fluid pressure in first upper plenum 202 thereupon decays as working fluid is vented into suction plenum 260 through orifice 262 and then to suction port 110 via passageway 264. With fluid pressure continuing to be supplied to lower plenum 220, piston assembly 194 is thereby made responsive to the decay of the fluid pressure within first upper plenum 202 for upward movement from its second to first orientation (FIG. 2) opening fluid flow path F1. For a fluid tight sealing of suction plenum 260, plate 250 may be provided with an outer packing seal, 269, and an inner shaft seal, 270.

Alternatively for the venting of the fluid pressure supplied into first upper plenum 202 for the actuation of distribution valving element 180, pilot valving element 210 instead may be provided as being of a three-way, solenoid-variety such as a type Gold Ring™ Series 30 manufactured by Parker-Hannifin Corp., Madison, Miss.. In such an arrangement, the piston orifice 262 may be closed, with the upper plenum pressure being vented to suction under the control of valving element 210 via passageway 218 (FIG. 4) and, for example, the passageway 272, represented in phantom in FIG. 4, which may extend (not shown) through housing body 100 into fluid communication with suction port 110. Advantageously, the use of a 3-way solenoid pilot eliminates the condition of discharge fluid bleeding directly to suction via the piston bleed orifice 262, and thereby may provide for more efficient operation of the refrigeration system. Solenoid pilot valves are further described in U.S. Pat. Nos. 5,553,829; 5,419,368; 5,303,012; 5,252,939; 5,127,624; 4,649,360; 4,624,282; 4,582,294; and 4,546,955.

Considering next the operation of check valving element 182 such element preferably is provided as a two-way shuttle, 280, received within second chamber 122. Similarly as with first lower valve seat 186, second upper and lower valve seats 266 and 268, may be seen to be integrally and radially-inwardly defined within second chamber 122 intermediate the second upper and lower end walls 156 and 160 thereof and as spaced apart axially along longitudinal axis 126 with upper valve seat 266 being disposed between ports 112 and 110, and with lower valve seat 268 being disposed between port 110 and passageway 170. For controlling the direction of fluid flow through valving element 182, the shuttle is provided as having an upper valve disc, 290, received within chamber 220 intermediate passageway 172 and second upper valve seat 266, and a lower valve disc, 292, received within chamber 122 intermediate second lower valve seat 268 and passageway 170. Lower valve disc 282 is operably coupled to upper valve disc 280 for movement therewith via an elongate stem portion, 294.

Each of the upper and lower valve discs 290 and 292 is formed as having at least one and, preferably, a plurality of axially-extending passageways, one of which is referenced at 300*a* for upper valve disc 290 and at 300*b* for lower valve disc 292. As is shown, passageways 300 may be formed as a series of peripheral channels or, alternatively, as orifices or other openings within the discs 290 and 292. In whatever form provided, however, each of the passageways 300 is disposed radially outwardly of its corresponding valve seat 266 or 268 so as to allow fluid communication through disc 290 along the fourth fluid flow path F4 (FIG. 2), and through disc 292 along the third fluid flow path F3 (FIG. 3).

Shuttle 280 is slidably received within chamber 280 for reciprocating movement along longitudinal axis 126 responsive to fluid flow within the first and second paths F1 and F2. In this regard, shuttle 280 is slidably movable between a first position, shown in FIG. 2, and a second position, shown in FIG. 3. In such first check position (FIG. 2), shuttle 280 is responsive to fluid flow admitted within the flow path F1 by distribution valving element 180 from inlet port 106 for upward movement within chamber 220 disposing lower disc 292 in an abutting engagement with second lower valve seat 268 closing the flow path F3 and opening path F4. That is, lower disc 292 is seated, responsive to fluid pressure and/or flow within path F1, on valve seat 268 radially outwardly of passageways 300*b* so as to block the flow of fluid therethrough from inlet port 106 and/or first reversing port 108. Upper valve disc 290, however, is axially spaced-apart from its corresponding upper valve seat 266 so as to admitted fluid flow through the passageways 300*a* from second reversing port 112 to suction port 110.

In turn, in such second check position (FIG. 3), shuttle 280 is responsive to fluid flow within the flow path F2, again admitted by distribution valving element 180 from inlet port 108, for downward movement within chamber 220 disposing upper disc 290 in an abutting engagement with second upper valve seat 266 closing the flow path F4 and opening path F3. That is, now upper disc 290 is seated, by fluid pressure and/or flow within path F2, on valve seat 266 radially outwardly of passageways 300*a* so as to block the flow of fluid therethrough from inlet port 106 and/or second reversing port 112. Lower valve disc 292, however, is axially spaced-apart from its corresponding lower valve seat 268 so as to admitted fluid flow through the passageways 300*b* from first reversing port 108 to suction port 110.

Advantageously, rather than under the influence of spring or other mechanical forces, the movement of shuttle 280 intermediate its first and second positions instead is under the control of fluid pressure acting upon the upper and lower discs as admitted from discharge port 106 by the orientation of distribution valving element 180. Such control allows the reversing function of valve assembly 50 to be effected with compressor discharge pressures as low as 15 psi and thereby makes the subject valve construction extremely energy efficient. Further, as once a reversing function is effected compressor discharge pressure is utilized to seat the shuttle disc of the check valving element, such construction also is seen as providing positive, leak-free performance which further optimizes system efficiency.

Considering lastly a representative operational sequence of valve 50 of the present invention within circuit 10 of FIG. 1, the sequence commences as shown in FIG. 2 with the operation of valve 50 in a heating or cooling mode wherein refrigerant is directed through first fluid flow path F1 from the discharge side 22 of compressor 12 to the first heat exchanger port 108, and from the second heat exchanger port 112 to the suction side 20 of the compressor 12. In such operation, working fluid pressure is supplied to first lower plenum 220 with pilot valve 210 (FIG. 4) being de-energized to dispose piston assembly 194 of distribution valving element 180 in its normally-biased first orientation opening path F1 and closing path F2. Concomitantly, fluid pressure is provided via path F1 to the lower valve disc 292 of shuttle 280 disposing the shuttle in its first position closing path F3 and opening path F4.

Continuing the sequence with reference to FIG. 2, valve 50 now is operated in a reverse mode wherein refrigerant is directed through second fluid flow path F2 from the discharge side 22 of compressor 12 to the second heat exchanger port 112, and from the first heat exchanger port 108 to the suction side 20 of the compressor 12. In such reverse mode, pilot valve 210 is energized to supply fluid pressure into first upper plenum 202 disposing piston assembly 194 in its second orientation opening path F2 and closing path F1. Concomitantly, fluid pressure is provided via path F2 to the upper valve disc 290 of shuttle 280 disposing the shuttle in its second position closing path F4 and opening path F3.

Thus, a unique and efficient directional control valve construction is described which integrates a reversible four-way valving function within a compact assembly.

Materials of construction suitable for the control valve of the present invention are to be considered conventional for the uses involved. Such materials generally will be corrosion resistant, but particularly will depend upon the fluid or fluids being handled. Molded plastic materials are preferred for weight considerations and for ease of manufacturing using conventional molding techniques, although other types of materials such as metals may be substituted, however, again as selected for compatibility with the fluid being transferred or for desired mechanical properties. Particularly, it is preferred that the housing, outer valve seats, and valve stem components be molded or otherwise formed of a glass-filled nylon or a glass-filled polyphenylene sulfide material such as that marketed under the tradename Ryton® by the Phillips Petroleum Co. of Bartlesville, Okla. The valve elements likewise may be molded from a thermoplastic material such as a polypropylene/monoolefin copolymer blend marketed commercially under the name Santoprene® by Advanced Elastomeric Systems, L. P., St. Louis, Mo.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. A valve for directing the flow of a working fluid therethrough comprising:

a housing having a first internal chamber extending along a first longitudinal axis and a second internal chamber extending along a second longitudinal and couplable in fluid communication with said first internal chamber by, selectively, a first and a second fluid flow path through said housing, said housing having an inlet port opening into said first chamber, an outlet port opening into said second chamber, and first and second reversing ports, said first reversing port being couplable in fluid communication with said inlet port by said first fluid flow path and with said outlet port by a third fluid flow path through said housing, and said second reversing port being couplable in fluid communication with said inlet port by said second fluid flow path and with said outlet port by a fourth fluid flow path through said housing;

a distribution valving element slidably received within said first chamber for reciprocating movement along said first longitudinal axis intermediate said first upper and lower valve seats between a first distribution position opening said first fluid flow path and closing said second fluid flow path, and a second distribution position opening said second fluid flow path and closing said first fluid flow path; and a check valving element freely slidably received within said second chamber for reciprocating movement along said second longitudinal axis between a first check position opening said fourth fluid flow path and closing said third fluid flow path, and a second check position opening said third fluid flow path and closing said fourth fluid flow path, said check valving element being responsive to fluid flow within said first fluid flow path to move from said second to said first check position, and being responsive to fluid flow in said second fluid flow path to move from said first to said second check position.

2. The valve of claim 1 wherein said second internal chamber of said housing extends intermediate a second upper and second lower end wall, and further comprising a second upper and a second lower valve seat defmed within said second internal chamber intermediate the second upper and lower end walls, said outlet port opening into said second internal chamber intermediate the second upper and lower valve seats, and said check valving element comprising:

an upper valve disc received within said second internal chamber intermediate said second upper end wall and said second upper valve seat, said second reversing port opening with said second fluid flow path into said second internal chamber intermediate said second upper end wall and said upper valve disc; and a lower valve disc operably coupled with said upper valve disc and received within said second internal chamber intermediate said second lower end wall and said second lower valve seat, said first reversing port opening with said first fluid flow path into said second internal chamber intermediate said second lower end wall and said lower valve disc, whereby said upper valve disc is formed as having at least one upper passageway therethrough disposed radially outwardly of said second upper valve seat and providing fluid communication along said fourth fluid flow path between said second reversing port and said outlet port when said check valving element is oriented in said first check position disposing said upper valve disc a spaced-apart axial distance from said second upper valve seat, and being abuttingly engaged with said second upper valve seat closing said fourth fluid flow path when said check valving element is disposed in said second check position, and said lower valve disc is formed as having at least one lower passageway therethrough disposed radially outwardly of said second lower valve seat and providing fluid communication along said third fluid flow path between said second reversing port and said outlet port when said check valving element is oriented in said second check position disposing said lower valve disc a spaced-apart axial distance from said second lower valve seat, and being abuttingly engaged with said second lower valve seat closing said third fluid flow path when said check valving element is disposed in said first check position.

3. The valve of claim 2 wherein:

said upper valve disc and said second upper end wall define a second upper plenum therebetween, said second fluid flow path opening into said upper plenum to provide positive fluid pressure therein retaining said upper valve disc against said second upper valve seat when said check valving element is disposed in said second check position, and said lower valve disc and said second lower end wall define a second lower plenum therebetween, said first fluid flow path opening into said lower plenum to provide positive fluid pressure therein retaining said lower valve disc against said second lower valve seat when said check valving element is disposed in said first check position.

4. The valve of claim 1 wherein said first internal chamber of said housing extends intermediate a first upper and first lower end wall, and further comprising a first upper and a first lower valve seat defined within said first internal chamber intermediate the first upper and lower end walls, said inlet port opening into said first internal chamber intermediate the first upper and lower valve seats, and said check valving element comprising:

a diversion valve disc received within said first internal chamber for movement intermediate the first upper and lower valve seats, said diversion valve disc being abuttingly engaged with said first lower valve seat closing said second fluid flow path when said distribution valving element is disposed in said first distribution position, and said diversion valve disc being and being abuttingly engaged with said first upper valve seat closing said first fluid flow path when said distribution valving element is disposed in said second distribution position; and a valve stem operably coupled to said distribution valve disc for moving said distribution valve disc intermediate the first upper and lower valve seats, said valve stem configured as having an upper piston head of a first diameter which defines with the first upper end wall of said housing a first upper plenum for receiving fluid pressure controlling the movement of said valve stem disposing said diversion valving element in said second distribution position, and a lower piston head of a second diameter which defines with the first lower end wall of said housing a first lower plenum for receiving fluid pressure controlling the movement of said valve stem disposing said diversion valving element in said first distribution position.

5. The valve of claim 4 wherein the first diameter of said upper piston head of said valve stem is larger than the second diameter of said lower piston head of said valve stem for developing a differential force imbalance biasing said valve stem in an orientation disposing said diversion valving element in said second distribution position when the fluid pressures in said upper and lower plenum are about equal.

6. The valve of claim 5 wherein both the fluid pressure received within the first upper and the fluid pressure received within the first lower plenum are supplied from said inlet port.

7. The valve of claim 6 further comprising a pilot valving element coupled in fluid communication with said inlet port and said first upper plenum, said pilot valving element being actuable to admit fluid pressure from said inlet port into said first upper plenum controlling the movement of said valve stem disposing said diversion valving element in said second distribution position.

8. The valve of claim 5 further comprising a suction plenum defined within said first internal chamber intermediate said upper piston head and said inlet port, said suction plenum being coupled in fluid communication with said outlet port and said upper piston head having an orifice formed therethrough connecting said first upper plenum in fluid communication with said suction plenum, whereby said valve stem is responsive to the decay of fluid pressure within said first upper plenum as vented through said orifice into said second upper plenum for moving said diversion valving element from said second position to first position.

9. The valve of claim 1 wherein said first internal chamber of said housing extends intermediate a first upper and first lower end wall, and further comprising a first upper and a first lower valve seat defined within said first internal chamber intermediate the first upper and lower end walls, said inlet port opening into said first internal chamber intermediate the first upper and lower valve seats, and said check valving element comprising:

a diversion valve disc received within said first internal chamber for movement intermediate the first upper and lower valve seats, said diversion valve disc being abuttingly engaged with said first lower valve seat closing said second fluid flow path when said distribution valving element is disposed in said first distribution position, and said diversion valve disc being and being abuttingly engaged with said first upper valve seat closing said first fluid flow path when said distribution valving element is disposed in said second distribution position; and a valve stem operably coupled to said distribution valve disc for moving said distribution valve disc intermediate the first upper and lower valve seats, said valve stem configured as having an upper piston head of a first diameter which defines with the first upper end wall of said housing a first upper plenum for receiving fluid pressure controlling the movement of said valve stem disposing said diversion valving element in said second distribution position; and biasing means for normally biasing said valve stem in an orientation in said second orientation disposing said diversion valving element in said first distribution position.

10. In a system wherein a flow of a refrigerant fluid is circulated through a closed-loop refrigeration circuit including a first heat exchanger, a second heat exchanger coupled in series to the first heat exchanger, and a compressor having a discharge side and a suction side, a valve for connecting the compressor discharge side to the first or second heat exchanger and, respectively, the compressor suction side to the second or first heat exchanger for the reversible operation of the system in alternate first and second modes, said valve comprising:

a housing having a first internal chamber extending along a first longitudinal axis and a second internal chamber extending along a second longitudinal axis and couplable in fluid communication with said first internal chamber by, selectively, a first and a second fluid flow path through said housing, said housing having a discharge port coupled in fluid communication with the discharge side of the compressor and opening into said first chamber, a suction port coupled in fluid communication with the suction side of the compressor and opening into said second chamber, and first and second heat exchanger ports each coupled in fluid communication with a corresponding one of the first and second heat exchangers, said first heat exchanger port being couplable in fluid communication with said discharge port by said first fluid flow path and with said suction port by a third fluid flow path through said housing, and said second heat exchanger port being couplable in fluid communication with said discharge port by said second fluid flow path and with said suction port by a fourth fluid flow path through said housing;

a distribution valving element slidably received within said first chamber for reciprocating movement along said first longitudinal axis intermediate said first upper and lower valve seats between a first distribution position opening said first fluid flow path and closing said second fluid flow path, and a second distribution position opening said second fluid flow path and closing said first fluid flow path; and a check valving element freely slidably received within said second chamber for reciprocating movement along said second longitudinal axis between a first check position opening said fourth fluid flow path and closing said third fluid flow path, and a second check position opening said third fluid flow path and closing said fourth fluid flow path, said check valving element being responsive to fluid flow within said first fluid flow path to move from said second to said first check position, and being responsive to fluid flow in said second fluid flow path to move from said first to said second check position.

11. The valve of claim 10 wherein said second internal chamber of said housing extends intermediate a second upper and second lower end wall, and further comprising a second upper and a second lower valve seat defined within said second internal chamber intermediate the second upper and lower end walls, said suction port opening into said second internal chamber intermediate the second upper and lower valve seats, and said check valving element comprising:

an upper valve disc received within said second internal chamber intermediate said second upper end wall and said second upper valve seat, said second heat exchanger port opening with said second fluid flow path into said second internal chamber intermediate said second upper end wall and said upper valve disc; and a lower valve disc operably coupled with said upper valve disc and received within said second internal chamber intermediate said second lower end wall and said second lower valve seat, said first heat exchanger port opening with said first fluid flow path into said second internal chamber intermediate said second lower end wall and said lower valve disc, whereby said upper valve disc is formed as having at least one upper passageway therethrough disposed radially outwardly of said second upper valve seat and providing fluid communication along said fourth fluid flow path between said second heat exchanger port and said suction port when said check valving element is oriented in said first check position disposing said upper valve disc a spaced-apart axial distance from said second upper valve seat, and being abuttingly engaged with said second upper valve seat closing said fourth fluid flow path when said check valving element is disposed in said second check position, and said lower valve disc is formed as having at least one lower passageway therethrough disposed radially outwardly of said second lower valve seat and providing fluid communication along said third fluid flow path between said second heat exchanger port and said suction port when said check valving element is oriented in said second check position disposing said lower valve disc a spaced-apart axial distance from said second lower valve seat, and being abuttingly engaged with said second lower valve seat closing said third fluid flow path when said check valving element is disposed in said first check position.

12. The valve of claim 11 wherein:

said upper valve disc and said second upper end wall define a second upper plenum therebetween, said second fluid flow path opening into said upper plenum to provide positive fluid pressure therein retaining said upper valve disc against said second upper valve seat when said check valving element is disposed in said second check position, and said lower valve disc and said second lower end wall define a second lower plenum therebetween, said first fluid flow path opening into said lower plenum to provide positive fluid pressure therein retaining said lower valve disc against said second lower valve seat when said check valving element is disposed in said first check position.

13. The valve of claim 10 wherein said first internal chamber of said housing extends intermediate a first upper and first lower end wall, and further comprising a first upper and a first lower valve seat defined within said first internal chamber intermediate the first upper and lower end walls, said discharge port opening into said first internal chamber intermediate the first upper and lower valve seats, and said check valving element comprising:

a diversion valve disc received within said first internal chamber for movement intermediate the first upper and lower valve seats, said diversion valve disc being abuttingly engaged with said first lower valve seat closing said second fluid flow path when said distribution valving element is disposed in said first distribution position, and said diversion valve disc being and being abuttingly engaged with said first upper valve seat closing said first fluid flow path when said distribution valving element is disposed in said second distribution position; and a valve stem operably coupled to said distribution valve disc for moving said distribution valve disc intermediate the first upper and lower valve seats, said valve stem configured as having an upper piston head of a first diameter which defines with the first upper end wall of said housing a first upper plenum for receiving fluid pressure controlling the movement of said valve stem disposing said diversion valving element in said second distribution position, and a lower piston head of a second diameter which defines with the first lower end wall of said housing a first lower plenum for receiving fluid pressure controlling the movement of said valve stem disposing said diversion valving element in said first distribution position.

14. The valve of claim 13 wherein the first diameter of said upper piston head of said valve stem is larger than the second diameter of said lower piston head of said valve stem for developing a differential force imbalance biasing said valve stem in an orientation disposing said diversion valving element in said second distribution position when the fluid pressures in said upper and lower plenum are about equal.

15. The valve of claim 14 wherein both the fluid pressure received within the first upper and the fluid pressure received within the first lower plenum are supplied from said discharge port.

16. The valve of claim 15 further comprising a pilot valving element coupled in fluid communication with said discharge port and said first upper plenum, said pilot valving element being actuable to admit fluid pressure from said discharge port into said first upper plenum controlling the movement of said valve stem disposing said diversion valving element in said second distribution position.

17. The valve of claim 14 further comprising a suction plenum defined within said first internal chamber intermediate said upper piston head and said discharge port, said suction plenum being coupled in fluid communication with said suction port and said upper piston head having an orifice formed therethrough connecting said first upper plenum in fluid communication with said suction plenum, whereby said valve stem is responsive to the decay of fluid pressure within said first upper plenum as vented through said orifice into said second upper plenum for moving said diversion valving element from said second position to first position.

18. The valve of claim 10 wherein said first internal chamber of said housing extends intermediate a first upper and first lower end wall, and further comprising a first upper and a first lower valve seat defined within said first internal chamber intermediate the first upper and lower end walls, said discharge port opening into said first internal chamber intermediate the first upper and lower valve seats, and said check valving element comprising:

a diversion valve disc received within said first internal chamber for movement intermediate the first upper and lower valve seats, said diversion valve disc being abuttingly engaged with said first lower valve seat closing said second fluid flow path when said distribution valving element is disposed in said first distribution position, and said diversion valve disc being and being abuttingly engaged with said first upper valve seat closing said first fluid flow path when said distribution valving element is disposed in said second distribution position; and a valve stem operably coupled to said distribution valve disc for moving said distribution valve disc intermediate the first upper and lower valve seats, said valve stem configured as having an upper piston head of a first diameter which defines with the first upper end wall of said housing a first upper plenum for receiving fluid pressure controlling the movement of said valve stem disposing said diversion valving element in said second distribution position; and biasing means for normally biasing said valve stem in an orientation in said second orientation disposing said diversion valving element in said first distribution position.

* * * * *